United States Patent [19]

O'Neill et al.

[11] 4,189,064

[45] Feb. 19, 1980

[54] PUMPS SPRAYER

[75] Inventors: Richard K. O'Neill; Roy T. Wells, both of Hacienda Heights, Calif.

[73] Assignee: Diamond International Corporation, New York, N.Y.

[21] Appl. No.: 911,503

[22] Filed: Jun. 1, 1978

[51] Int. Cl.[2] ..... B05B 9/043

[52] U.S. Cl. ..... 222/321; 222/385; 417/560; 417/566

[58] Field of Search ..... 222/321, 380, 383, 385; 239/331, 333; 417/559, 560, 566

[56] References Cited

U.S. PATENT DOCUMENTS

| | | | |
|---|---|---|---|
| 4,025,046 | 5/1977 | Boris | 222/385 X |
| 4,051,983 | 10/1977 | Anderson | 222/321 |
| 4,089,442 | 5/1978 | Hafele et al. | 222/321 |
| 4,140,249 | 2/1979 | Majima | 239/333 X |
| 4,144,987 | 3/1979 | Kishi | 239/333 X |

FOREIGN PATENT DOCUMENTS

| | | | |
|---|---|---|---|
| 2285815 | 4/1975 | France | 222/321 |

*Primary Examiner*—Robert J. Spar

*Assistant Examiner*—Frederick R. Handren

*Attorney, Agent, or Firm*—Watson, Cole, Grindle & Watson

[57] ABSTRACT

A dispensing pump of the pressure build-up variety includes a cylinder defining a variable volume pump chamber, and a main piston reciprocable therein, the piston having a valve seat thereon communicating with a discharge passage leading to a discharge nozzle. A valve member having a smaller diameter piston thereon is moved during pressure build-up away from the seat for opening the discharge passage. The smaller diameter piston has a flexible peripheral wall which is deformed inwardly at the commencement of the piston downstroke for closing a flow passage in the smaller diameter piston and thereby interrupting communication between the inlet and the pump chamber, such flow passage being open upon outward movement of such peripheral wall at the end of the piston upstroke. At the top of the cylinder along which the smaller diameter piston moves is a relieved section effecting the opening of the flow passage in an inoperative condition of the pump.

14 Claims, 9 Drawing Figures

21
34
35
36
38
4
4
49
44
45
46
53
12
41
43
13
42

PUMPS SPRAYER

BACKGROUND OF THE INVENTION

This invention relates generally to a dispensing pump, and more particularly to such a pump of the pressure build-up variety in which communication between the liquid inlet and the pump chamber is established and interrupted by a valve controlled flow passage located in a small diameter piston member movable with a valve member which opens and closes the discharge passage.

Pressure build-up pumps of the general type hereof are disclosed in U.S. Pat. No. Re. 28,366 and in U.S. Pat. No. 4,051,983, both commonly owned herewith, as well as in U.S. Pat. No. 4,025,046 and in German Offenlegungsschrift No. 27 13 447. All of these pumps function in a similar manner in that a valve seat, carried by a main piston, is opened upon the build-up of pressure in the pump chamber and is closed when that pressure is overcome by the force of a spring moving a valve member into its closing position. When the discharge passage is open, the fluid inlet to the pump chamber is interrupted and, while the discharge passage is being closed, the fluid inlet to the pump chamber is re-established.

The inlet to the pump chamber, in the Reissue Patent as well as in the '983 patent, is controlled by a ball-type check valve associated with the smaller diameter piston so as to be unseated during the upstroke of the pistons during a differential pressure on opposite sides of the lower or smaller diameter piston. In another embodiment set forth in the Reissue Patent, the smaller diameter piston has a flexible wall which is caused to move away from the wall of the lower cylinder bore in response to such pressure differential.

In both the '046 patent and in the German Offenlegungsschrift, means movable during operation of the piston engages an element extending into the lower bore of the pump cylinder for interrupting communication between the inlet and the pump chamber. In the '046 patent, such a means comprises a sleeve made rigid with either the piston member or with the valve member, and in the German Offenlegungsschrift such a means comprises a rod or sleeve extension of the valve member.

OBJECTS OF THE INVENTION

It is an object of the present invention to provide a dispensing pump which operates upon pressure build-up in the pump chamber to open the discharge passage similarly as before, except that the liquid inlet is controlled in a more efficient and economical manner by means of an improved valve controlled flow passage located in the smaller diameter piston and actuated by engagement between the smaller diameter piston, the flow passage being closed upon deformation of a portion of the smaller diameter piston. The disadvantages in the use of ball-type check valves are therefore avoided, and control of the lower piston flow passage is improved.

Another object of the invention is to provide such a dispensing pump wherein the smaller diameter piston has a flexible peripheral wall which is deformed inwardly at the commencement of the piston downstroke for closing the smaller diameter piston flow passage and thereby interrupting communication between the inlet and the pump chamber, such flow passage being open upon outward movement of such peripheral wall at the end of the piston upstroke.

A further object of the present invention is to provide such a dispensing pump wherein a section of the piston cylinder at the lower bore thereof is relieved at a predetermined location at the beginning of the downward stroke of the smaller diameter piston for effecting an open condition of the flow passage, a circumferential inner section of the peripheral wall being moved during the downward stroke into sealing engagement with an adjacent portion of the smaller diameter piston to close the flow passage which extends between the peripheral wall and the adjacent portion.

A still further object of this invention is to provide such a dispensing pump wherein a portion of the peripheral wall extends radially outwardly into bearing contact with the inner wall of the cylinder, such wall being defined by a flexible annular upwardly facing skirt having a base portion.

A still further object of the present invention is to provide such a dispensing pump wherein the flow passage through the smaller diameter piston is defined by at least one hole located in its base portion.

A still further object is to provide such a pump wherein the flow passage is defined by a hollow bore provided in the smaller diameter piston, and an opening located in the wall of such bore.

Other objects, advantages and novel features of the invention will become more apparent from the following detailed description of the invention when taken in conjunction with the accompanying drawings.

DETAILED DESCRIPTION OF THE INVENTION

Figure 1:
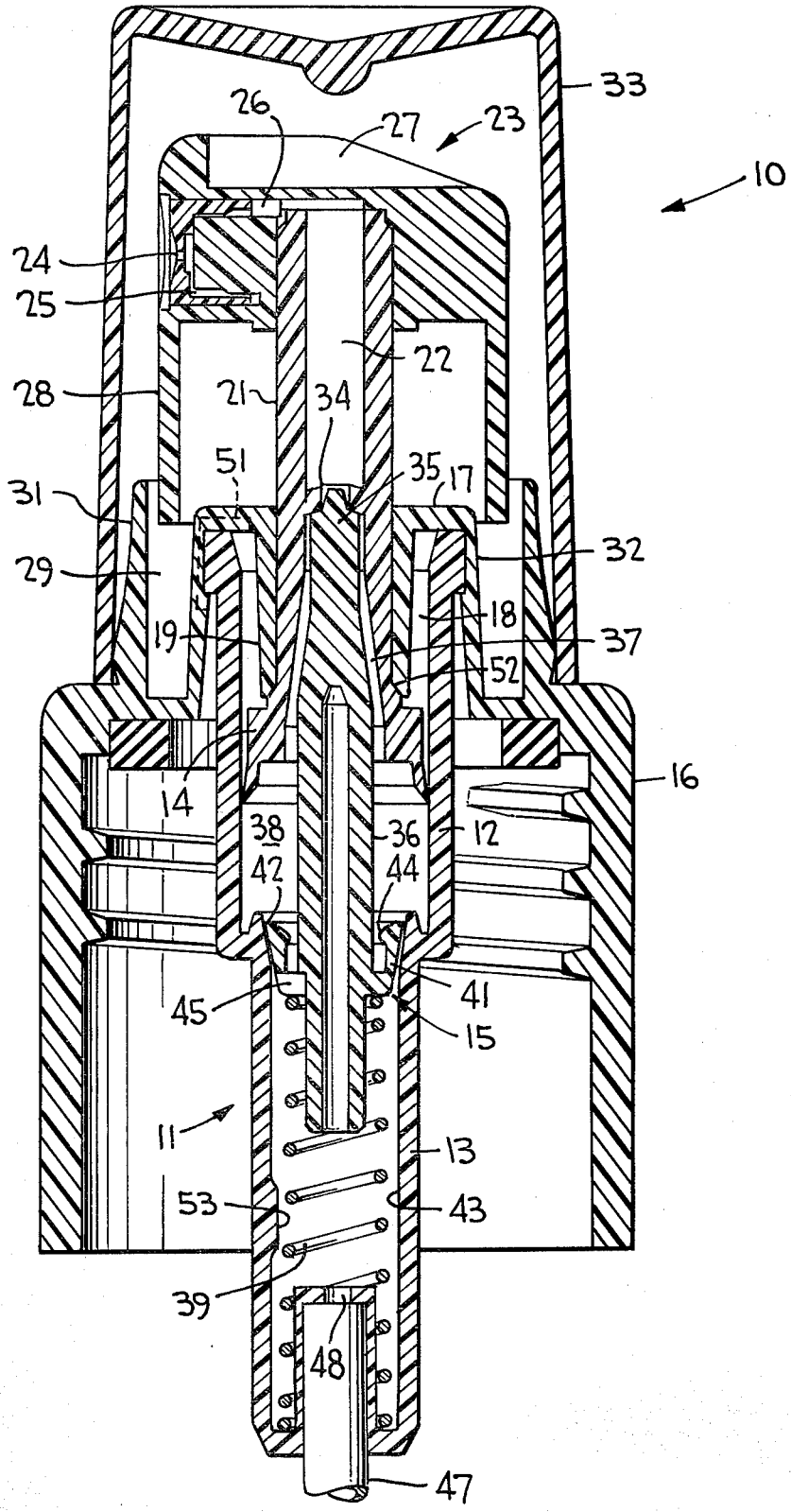
FIG. 1 is an axial sectional view of the pump sprayer according to one embodiment of the invention, the pump plunger being shown in its fully raised inoperative position.

Turning now to the drawings wherein like reference characters refer to like and corresponding parts throughout the several views, the pump sprayer according to one embodiment of the invention is generally designated 10 in FIG. 1 and is similar in many respects to the construction of the pump disclosed in U.S. Pat.

No. 4,051,983, the entirety of the disclosure of which therefore being specifically incorporated herein by reference. The pump comprises a pump housing 11 in the form of a pump cylinder having an upper section 12 of a first predetermined large diameter, and having a lower section 13 of a second relatively smaller diameter. A main or larger diameter pump piston 14 is disposed within the cylinder for reciprocation along section 12, and a smaller diameter pump piston 15 is disposed in the pump cylinder for reciprocation along section 13. Pump housing 11 is open at its upper end and is supported by a conventional container closure in the form of an internally threaded cap 16. A domed portion 17 of the cap defines a downwardly opening annular recess 18 into which the upper end of section 12 is snap fitted into place. An inner annular skirt 19 depends from dome 17 and surrounds a hollow piston rod 21 extending upwardly of piston 14 and being designed to reciprocate within skirt 19. The hollow piston rod defines a discharge passage 22, and a conventional spray-type discharge head 23 is mounted at the upper end of rod 21. The head has a spray orifice 24 communicating through suitable passages 25 and 26 with the hollow piston rod for discharging the liquid product to the atmosphere in the form of a fine spray. An upper surface 27 of the spray head is conformed to receive downward finger pressure for the purpose of reciprocating main piston 14.

A depending skirt 28 on head 23 extends into an annular space 29 defined between annular walls 31 and 32. If desired, a conventional protective over-cap 33 may be applied to and either snap fitted or friction fitted onto outer wall 31, as clearly shown in FIG. 1 with the pump sprayer in an inoperative and storage position with cap 33 in place.

A valve seat defined by a discharge port 34 is located within hollow piston rod 21, the port being normally maintained closed by means of a discharge valve 35 forming an extension of a piston rod 36 on which smaller diameter piston 15 is mounted as shown. Valve member 35 is mounted for reciprocable movement within hollow rod 21 and defines therewith an annular space 37 interconnecting discharge port 35 with a pump chamber 38 defined by the pump cylinder and pistons 14, 15 as an expansible and contractible pump chamber. Valve member 35 is maintained in its closed and seated position by the force of a coil spring 39 compressed between lower piston 15 and the lower end of the lower bore or section 13. The valve member is, however, unseated whenever the pressure within chamber 38 exceeds the force of the spring.

Figures 2, 3, 4:
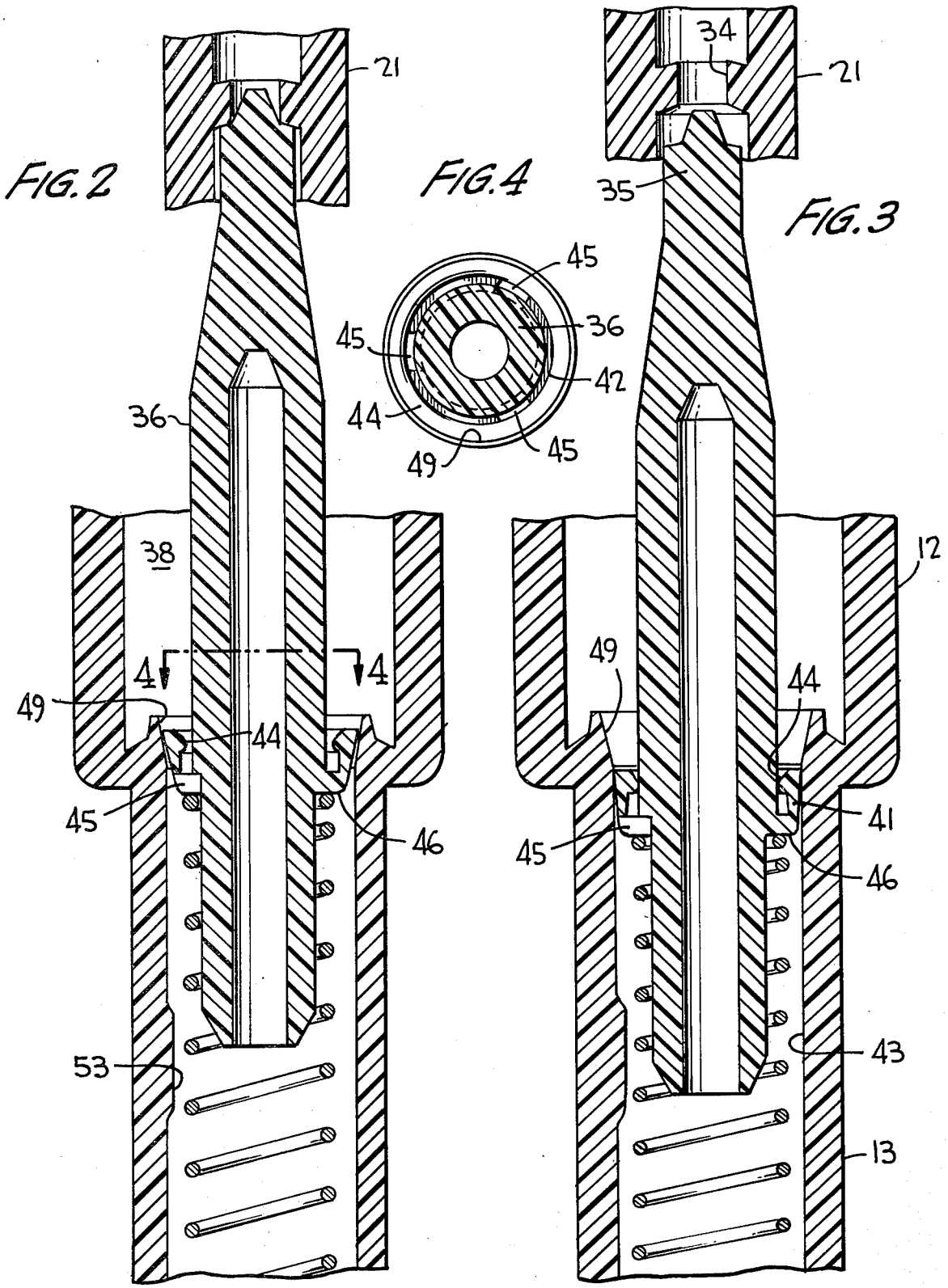
FIG. 2 is a view similar to FIG. 1 but at a slightly enlarged scale showing that portion to which the invention is directed in greater detail.
FIG. 3 is a view similar to FIG. 2 showing the pump sprayer in its operative position.
FIG. 4 is a sectional view taken substantially along line 4—4 of FIG. 2.

Lower piston 15 is defined by a resiliently radially deformable peripheral wall 41 in the form of a flexible annular skirt having a radially outwardly and upwardly directed free end edge 42 in constant sealing engagement with inner wall 43 of section 13 throughout the entire circumference thereof. A continuous annular bead 44 is disposed on the inner surface of peripheral wall 41 and, in an operative condition of the pump as shown in FIGS. 1 and 2, is spaced outwardly of piston rod 36. Lower piston 15 is provided with a flow passage therethrough defined by a plurality of radially spaced openings 45 extending through base portion 46 defined as part of the flexible skirt of the lower piston. An open flow passage is thereby established between pump chamber 38 and a fluid inlet defined by a dip tube 47 opening into section 13 of the pump cylinder at the lower end thereof through an opening 48. The lower end of the dip tube extends into a supply of liquid to be dispensed from a container or bottle (not shown) to which closure cap 16 and its associated pump are applied. This flow passage extends between wall 41 and an adjacent portion of rod 36, so that communication between the pump chamber and the inlet is interrupted during operation of the pump as peripheral wall 41 is deformed inwardly thereby causing rib 44 to be placed in sealing engagement with piston rod 36, as shown in FIG. 3. Inner wall 43 has, at the upper end of section 13, a relieved circumferential section 49 (most clearly seen in FIG. 3) which slopes inwardly and downwardly from the upper edge of section 13 and merges with the remainder of wall 43 of constant diameter. Thus, in the inoperative condition of the pump shown in FIG. 2, relieved section 49 allows peripheral wall 41 and its bead 44 to be spaced radially outwardly of the adjacent portion of rod 36 whereby to maintain an open condition of the flow passage through openings 45. In an operative condition of the pump, during reciprocation of the pistons, the flow passage through the smaller diameter piston is closed (FIG. 3) as wall 41 is deformed inwardly while end edge 42 slides along wall 43 beneath its relieved section. Openings 45 are therefore closed whereupon communication between the inlet and pump chamber 38 is interrupted shortly following commencement of pump operation (FIG. 3) and continuing throughout reciprocation of the pistons.

Valve controlled venting means is provided for the present pump sprayer for the purpose of equalizing the pressure within and outside the container when the pump is in operation, and for interrupting communication between the inside and outside of the container when the pump is in its stationary or storage position to thereby prevent leakage or loss of the liquid product. Such a venting means is disclosed in the aforementioned U.S. Pat. No. 4,051,983 and is adopted here. Thus, a passageway 51 is provided in wall 32 and in dome portion 17 for establishing communication between annular space 18 and the interior of the container in which the liquid product is contained. Therefore, when main piston 14 is depressed, air may pass downwardly from the atmosphere through the clearance space between hollow piston rod 21 and its guide collar 19 to a location within section 12 above the main piston, and may then flow through passageway 51 around the upper peripheral edge of the pump chamber, and thereafter downwardly into the container. Such communication is, however, disrupted in the fully raised position of pump piston 14, as shown in FIG. 1, by means of an annular valve defined by an enlarged diameter portion 52 of the piston rod exterior which seats against the downwardly and outwardly flared inner periphery of collar 19.

The priming valve structure of the '983 patent is likewise adopted for the present pump sprayer in that a small ramp or proturberance 53 is provided on inner wall 45 of section 13 so as to engage and inwardly deflect a localized portion of peripheral wall 41 of the lower piston, when such piston is at or near the lower extremity of its downward stroke. A downward flow of entrapped air from pump chamber 38 is thereby permitted to flow into lower section 13, through dip tube 47 and back into the container. Further details of the construction of protuberance 53 and the accompanying priming feature of U.S. Pat. No. 4,051,983, are omitted for the sake of brevity.

Figure 5:
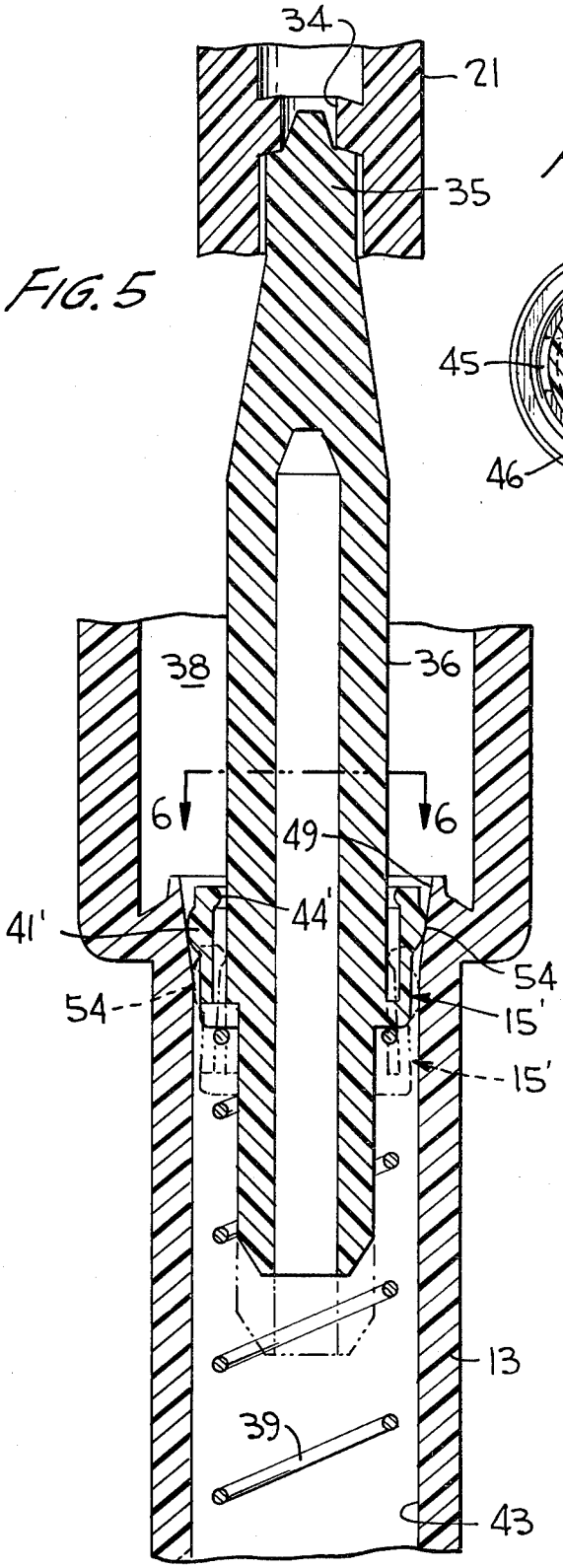
FIG. 5 is a view similar to FIG. 2 but showing another embodiment according to the invention with the pump sprayer in an inoperative condition in solid outline and in an operative condition in phantom outline.
Figure 6:
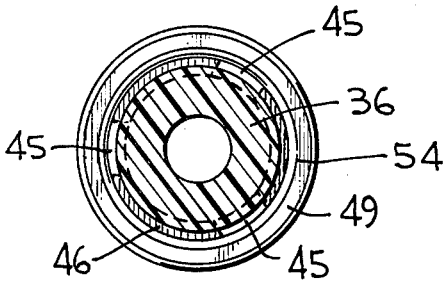
FIG. 6 is a sectional view taken substantially along line 6—6 of FIG. 5.

Another embodiment of the lower piston is shown in FIG. 5 as piston 15' constructed similarly as piston 15 aforedescribed except that its peripheral wall or skirt 41' is provided with a radially extending circumferential rib 54 on its outer surface, in lieu of a radially extending end edge, which constantly engages the entire circumference of the inner wall of section 13. In the inoperative pump position shown in solid outline in FIG. 5, and in FIG. 6, rib 54 engages relieved section 49 of inner wall 43 so that, shortly after commencement of the downstroke of the pistons, rib 54 is moved into engagement with the uniform diameter portion of inner wall 43 thereby effecting inward deformation of peripheral wall 15' which in turn causes its inner rib 44' to sealingly engage piston rod 36, as shown in phantom outline in FIG. 5. It should be pointed out that, in both embodiments, the extent of section 49 is such as to maintain the flow passage through the lower piston open when in an inoperative position of the pump, and the inward radial extent of ribs 44,44' are such as to effectively seal against piston rod 36 when end edge 42 or outer rib 54 slide against the inner wall of the cylinder's lower section during operation of the pump.

Figure 7:
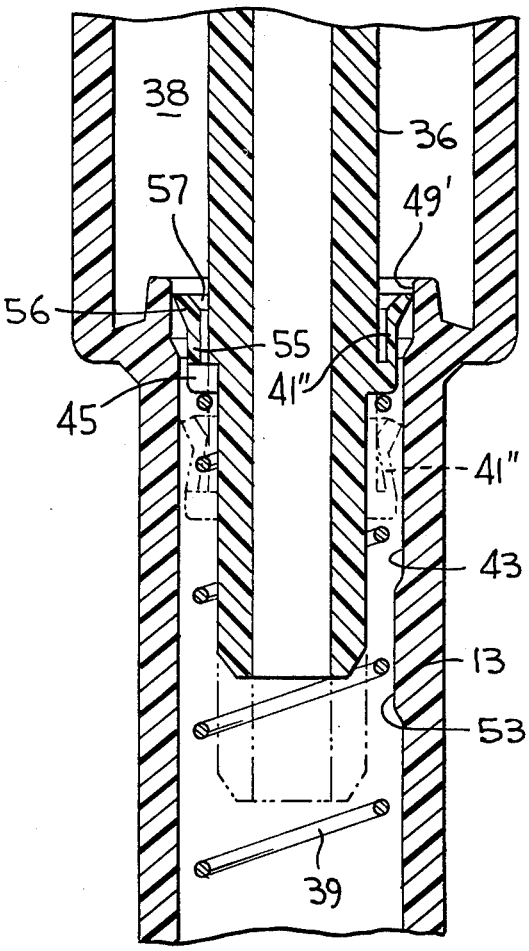
FIG. 7 is a view similar to FIG. 5 but showing still another embodiment according to the invention with the pump sprayer in an inoperative condition in solid outline and in an operative condition in phantom outline.

A further embodiment of the pump sprayer according to the invention is shown in FIG. 7 of like construction and operation to that of FIG. 1 except that a relieved section 49' is provided at the upper end of wall 43 which is slightly different from section 49 of the other embodiments. Section 49' has a larger diameter wall portion coaxial with wall 43, as well as a downwardly and inwardly sloping wall portion which merges with wall 43. And, the smaller diameter piston includes a peripheral wall 41" located on piston rod 36, wall 41" having a portion 55 lying coaxial with rod 36 in an inoperative condition of the pump (shown in solid outline in FIG. 7), and having a portion 56 flaring radially outwardly therefrom. Thus, in such inoperative condition, the flow passage through openings 45 remains open. During pump operation, as shown in phantom outline in FIG. 7, portion 56 engages wall 43 lying below its section 49' thereby causing wall 41" to radially deform inwardly such that a portion 57 at the junction between 55 and 56 is brought into sealing engagement with an adjacent portion of rod 36. The flow passage through openings 45 is thus closed and communication between the pump chamber and the inlet to the pump is thereby interrupted. Such communication is re-established when the smaller diameter piston reaches the end of its upward stroke, as shown in solid outline in FIG. 7.

Figure 8:
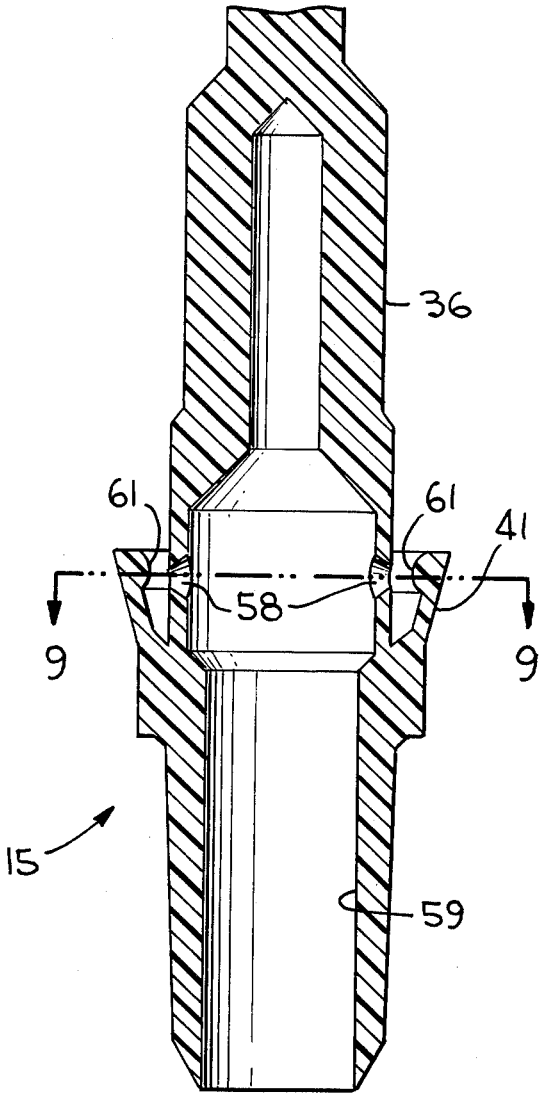
FIG. 8 is a longitudinal sectional view of part of a smaller diameter piston usable with the pumps according to FIGS. 1 and 7, and showing a modified flow passage.
Figure 9:
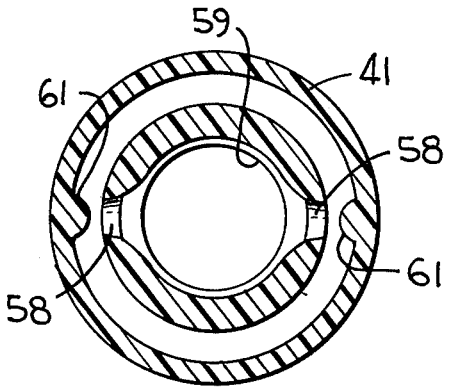
FIG. 9 is a sectional view taken substantially along line 9—9 of FIG. 8.

The flow passage through smaller diameter piston 15 may be alternatively defined as in FIGS. 8 and 9. Here, peripheral wall 41 flares radially outwardly as in FIG. 1 except that opposed openings 58 are provided in the wall of hollow rod 36. The flow passage therefore likewise extends through piston 15 and is routed between wall 41 and piston rod 36 from bore 59 of the rod. Small opposing protuberances 61 (FIGS. 8 and 9) on the inner surface of wall 41 are in radial alignment with openings 58 for closing same in an operative condition of the pump (similar to that shown in FIG. 3) to thereby close the flow passage during reciprocation of the pistons.

In operation, after the pump is primed, it will function in the manner of a pressure build-up pump. Thus, with pump chamber 38 primed with the liquid product to be dispensed, downward finger pressure on head 23 will initiate downward movement of upper piston 14 on its operative stroke. Throughout the initial portion of this stroke, valve member 35 will be retained seated so as to maintain passageway 22 closed by the upward force of spring 39 acting against lower piston 15. At the commencement of the downstroke movement of the pistons, the lower piston is disposed at the position shown in FIG. 2 and at the position shown in solid outline in FIGS. 5 and 7. As the piston downstroke movement continues, the peripheral wall of the lower piston, at its end edge 42, at its outer rib 54 or at its portion 56, slides along sloping section 49 or 49' whereupon the peripheral wall gradually deforms upwardly until its inner bead 44,44' or junction 57 engages piston rod 36. Such engagement takes place when edge 42 or bead 54 or portion 56 engages the uniform diameter portion of inner wall 43, as shown in FIGS. 3, 5 and 7, respectively. Openings 45, or 58 of the FIG. 8 piston, are thus closed thereby interrupting communication between pump chamber 38 and the inlet below the lower piston so as to prevent any backflow of liquid product from the pump chamber to the container. At some point during continuation of the downstroke, the degree of compression of liquid product within the pump chamber will be such that the amount of thrust transmitted to the lower piston will exceed the upward thrust of spring 39, with the result that the lower piston will move downwardly at a higher velocity as compared to the upper piston. This in turn will cause discharge valve 35 to open, and to remain open as long as such differential pressure is maintained, during which time the liquid product is discharged through the open discharge passage 22 and the spray discharge nozzle. If the pressure drops, however, the discharge valve is automatically closed by the spring pressure to prevent discharge of liquid at a predetermined pressure below that desired.

Thereafter, when finger pressure on the spray discharge head is released, the pistons commence their upward stroke, by energy stored in the spring. Upward movement of the pistons produces a pressure drop below the lower piston so that liquid is caused to rise via suction tube 47 into lower section 13 and, when the peripheral wall of the lower piston is moved into engagement with section 49, the flow passage through openings 45 is opened whereupon liquid product refills the pump chamber. Also, the rise of piston 14 produces a negative pressure in the pump chamber so that liquid continues to be drawn into the pump chamber through the open flow passage of the lower piston. The downstroke movement of the pistons as aforedescribed may then be continued for further operation of the pump.

Obviously, many modifications and variations of the invention are made possible in the light of the above teachings. It is therefore to be understood that within the scope of the appended claims the invention may be practiced otherwise than as specifically described.

We claim:

1. In a pump sprayer including a cylinder having first and second sections defining a variable volume pump chamber, a discharge nozzle, discharge passage means interconnecting said first portion and said nozzle, liquid inlet means communicating with said second section, a first piston member reciprocable along said first section for building-up the pressure in said chamber for discharge through said passage means and out of said nozzle, a valve seat on said first piston member, a valve member engageable with said seat for opening and closing same upon movement relative thereto, means biasing said valve member into engagement with said seat, a second piston member connected to said valve member and having a resiliently radially deformable peripheral wall in constant sealing engagement with the inner wall of said second section throughout the entire circumference thereof, said second piston member being reciprocable along said second section, the improvement wherein said second piston member is provided with a valve controlled flow passage therethrough and lying between said peripheral wall and an adjacent portion of said second piston member for establishing and interrupting communication between said first and second sections respectively upon an opening and closing of said flow passage, said inner wall having a relieved section located at a predetermined location at the beginning of the downward stroke of said second piston member for allowing said peripheral wall to become spaced from said adjacent portion in an open condition of said flow passage, said peripheral wall being inwardly deformed against said adjacent section for closing said flow passage during said downward stroke.

2. The pump sprayer according to claim 1, wherein a circumferential rib is provided on said peripheral wall and extends toward said adjacent section.

3. The pump sprayer according to claim 1, wherein said peripheral wall is defined by a flexible annular skirt extending toward said first piston member, a portion of said skirt extending radially outwardly into engagement with said inner wall.

4. The pump sprayer according to claim 3, wherein said portion of said skirt comprises a free end edge of said peripheral wall.

5. The pump sprayer according to claim 3, wherein said portion of said skirt comprises a sealing rib on the outer surface of said peripheral wall.

6. The pump sprayer according to claim 3, wherein said skirt includes a base portion, and said flow passage is defined by at least one opening in said base portion.

7. The pump sprayer according to claims 2 or 3, wherein said flow passage is defined by a hollow bore provided in said second piston member and an opening located in the wall of said bore.

8. In a pump sprayer including a pair of aligned upper and lower pistons of relatively large and small diameters respectively working in different diameter portions of a common pump chamber having its lower end adapted for communication with a supply of liquid to be dispensed from a container through a dip tube connected to said lower end; said pistons respectively having valve controlled first and second flow passages therethrough to permit only an upward flow of liquid through said pump chamber; and means for reciprocating said pistons substantially in phase with each other for varying the volume of said pump chamber delimited by said pistons; said small diameter piston having a resiliently radially deformable peripheral wall in sealing engagement with the inner wall of said pump chamber throughout the entire circumference thereof;

the improvement wherein said inner wall is provided with a relieved section located at a predetermined axial location at the beginning of the downward stroke of said small diameter piston to allow said second flow passage to open; and said second flow passage extending between said peripheral wall and a portion of said small diameter piston, said peripheral wall being deformed radially inwardly against said portion for closing said second flow passage after the beginning of said downward stroke.

9. The pump sprayer according to claim 8, wherein said first flow passage is defined by a valve seat on said upper piston, a valve member engageable with said seat for controlling said first flow passage, said portion of said small diameter piston extending from said valve member.

10. The pump according to claim 9, wherein said peripheral wall is defined by a flexible annular skirt extending toward said upper piston, a portion of said skirt extending radially outwardly into engagement with said inner wall, and a continuous rib on said peripheral wall extending radially inwardly of said skirt.

11. The pump according to claim 10, wherein said portion of said skirt comprises a free end edge of said peripheral wall.

12. The pump according to claim 10, wherein said portion of said skirt comprises a sealing rib on the outer surface of said peripheral wall.

13. The pump according to claim 10, wherein said skirt includes a base portion, and said second flow passage is defined by at least one opening in said base portion.

14. The pump according to claim 10, wherein said second flow passage is defined by a hollow bore provided in said small diameter piston, and an opening located in the wall of said bore.

* * * * *